US006053245A

United States Patent [19]

Haberman

[11] Patent Number: 6,053,245

[45] Date of Patent: Apr. 25, 2000

[54] METHOD FOR MONITORING THE SETTING OF WELL CEMENT

[75] Inventor: John P. Haberman, Houston, Tex.

[73] Assignee: Gas Research Institute, Chicago, Ill.

[21] Appl. No.: 09/034,127

[22] Filed: Mar. 3, 1998

[51] Int. Cl.[7] ..... E21B 33/13

[52] U.S. Cl. ..... 166/250.14; 166/253.1; 166/285; 73/152.57

[58] Field of Search ..... 166/250.14, 253.1, 166/285; 73/152.57, 152.55, 152.51

[56] References Cited

U.S. PATENT DOCUMENTS

| | | | |
|---|---|---|---|
| 4,093,028 | 6/1978 | Brandon . | |
| 4,512,401 | 4/1985 | Bodine . | |
| 4,571,993 | 2/1986 | St. Onge | 73/151 |
| 4,736,794 | 4/1988 | Bodine . | |
| 4,769,601 | 9/1988 | Herrick . | |
| 4,823,594 | 4/1989 | Gray . | |
| 5,009,272 | 4/1991 | Walter . | |
| 5,152,342 | 10/1992 | Rankin et al. . | |
| 5,361,837 | 11/1994 | Winbow . | |
| 5,377,753 | 1/1995 | Haberman et al. . | |
| 5,571,951 | 11/1996 | Jamth . | |

OTHER PUBLICATIONS

J.B. Haberman and S.L. Wolhart: Reciprocating Cement Slurries After Placement by Applying Pressure Pulses in the Annulus, a paper prepared for presentation at the 1997 SPE/IADC Drilling Conference, Amsterdam, The Netherlands, Mar. 4–6, 1997; published by Society of Petroleum Engineers/International Association of Drilling Contractors, 1997.

*Primary Examiner*—William Neuder
*Assistant Examiner*—Zakiya Walker
*Attorney, Agent, or Firm*—Pauley Petersen Kinne & Fejer

[57] ABSTRACT

An improved method of monitoring the setting of a settable liquid-containing material is provided. The compressibility of one or more fluids including the settable material is monitored at periodic intervals during the setting process. As the material sets, its compressibility is lowered, and the overall fluid compressibility is reduced. When the settable material hardens completely, its compressibility approaches zero and the overall fluid compressibility levels off. The method is especially useful for monitoring the setting of cement in the annulus of a well bore, and for determining when the cement is fully set.

23 Claims, 3 Drawing Sheets

METHOD FOR MONITORING THE SETTING OF WELL CEMENT

FIELD OF THE INVENTION

The invention is directed to a method for monitoring the setting of a solid/liquid slurry, such as a cement slurry, by measuring the compressibility of fluids including that portion of the slurry remaining in the fluid state. The invention is more particularly directed to a method of monitoring the setting of cement surrounding the casing of a well by measuring fluid compressibility in the annulus surrounding the casing.

BACKGROUND OF THE INVENTION

Once a gas or oil well bore has been drilled, casing is typically lowered into the well bore. The casing is then cemented into place by pumping a liquid cement slurry into the annular space between the casing and the well bore. This generally requires displacement of drilling fluid in the annulus by the cement slurry.

Once the cement slurry is in place, it must be permitted to harden and solidify before operations relating to drilling and completing the well can be resumed. Because the cemented annulus extends thousands of feet into the ground, it is difficult to know when the solidification of cement is complete. Due to the high cost of rig time, there is an incentive to accurately monitor the solidification process and, thus, minimize the delay in operations.

U.S. Pat. No. 5,377,753, issued to Haberman et al., discloses a technique of transmitting pressure waves down the well bore from the surface of the cement slurry, and measuring the time required for the waves to reflect back to the surface. The pressure waves can be transmitted using a fluid, such as air or water, which is injected at the surface. The cement generally becomes solid at the bottom of the well first, because of the higher temperature. The solidification then progresses up the well. The reflection of pressure waves from the highest location of set cement can thus be used to measure the progress of the setting.

U.S. Pat. No. 4,769,601, issued to Herrick, discloses a testing method which uses nuclear magnetic resonance to determine the setting time of cement. This method is not adapted for use in situ in an oil well.

There is a need or desire in the oil industry for an improved testing method for monitoring the setting of cement in an oil well bore.

SUMMARY OF THE INVENTION

The present invention is directed to a method for monitoring the setting of a solid/liquid slurry, such as a cement slurry, and is especially useful for monitoring the setting of cement used to seal casing in wells. An applied fluid, such as water or air, is injected into a closed volume above the surface of the solid/liquid slurry. In a gas or oil well annulus, drilling fluid generally fills the space immediately above the slurry, and the applied fluid is injected above the drilling fluid. The pressure in the volume occupied by applied fluid is monitored while the fluid is being injected. The volume of applied fluid required to increase and hold the pressure is determined. The applied fluid may be injected in pulses.

Compression of the slurry is achieved when the applied fluid pressure rises and holds following injection. At that point, the compressibility of all contained fluids can be monitored by comparing the volume of applied fluid injected to the change in pressure. The measurement can be reported in gallons per psi change. Once the measurement has been taken, the applied fluid pressure can be released.

As the slurry solidifies, its overall compressibility is reduced. The total compressibility of all contained fluids is at a maximum when all of the settable material is in slurry form, and none is solidified. The total compressibility of all contained fluids is at a minimum, and levels off, when all of the settable material has solidified. When the settable material is partially solidified, the total compressibility of all contained fluids is between the maximum and minimum values.

With the foregoing in mind, it is a feature and advantage of the invention to provide an improved method for monitoring the setting of a slurry, such as cement, and for determining when the material is completely set, by monitoring fluid compressibility.

In particular, it is a feature and advantage of the invention to provide an improved method for monitoring the setting of cement in the annulus of an oil well bore, and for determining when the cement is completely set.

The foregoing and other features and advantages of the invention will become further apparent from the following detailed description of the presently preferred embodiments, read in conjunction with the accompanying drawings and examples. The detailed description is intended to be merely illustrative rather than limiting, the scope of the invention being defined by the appended claims and equivalents thereof.

DETAILED DESCRIPTION OF THE PRESENTLY PREFERRED EMBODIMENTS

Figure 1:
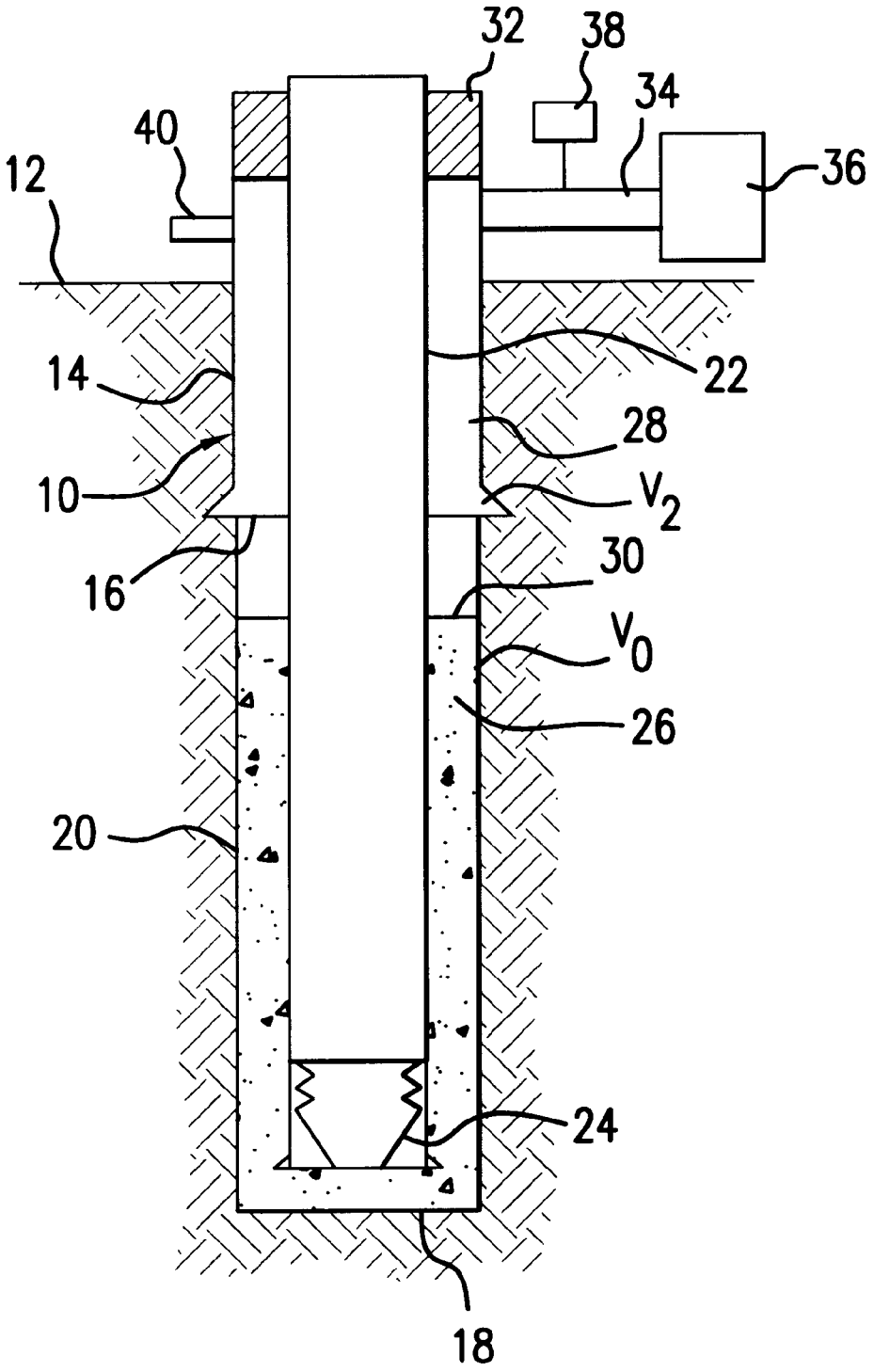
FIG. 1 is a schematic illustration of a well bore, including casing and apparatus for monitoring the setting of cement in the annulus between the well bore and casing.

For a liquid or liquid-containing slurry, such as water-containing cement, the volume under an applied pressure is generally proportional to the volume under atmospheric pressure (i.e., no applied pressure) multiplied by the amount of the applied pressure. The following equation illustrates the relationship:

$$\Delta V = -BV_0\Delta P$$

where $\Delta V$ = Change in volume under pressure.

$B$ = A constant. For pure water, $B = 4.2\times10^{-5}$ atm$^{-1}$.

$V_0$ = Total volume before the change in pressure.

$\Delta P$ = The change in pressure.

Put another way, the ratio $-\Delta V/\Delta P$ is a constant ($K_1$) for water or a water-containing cement slurry, over the ranges of temperature and pressure found in wells. This constant is known as the compressibility, and may vary depending on the size and shape of the object containing the water. Liquid water has a theoretical compressibility of about 0.018 gal/psi, for the annular volume of wells in a particular field known as the "Queen" field, referred to herein for illustrative purposes. A water-containing cement slurry may have a lower theoretical compressibility of say, 0.012 gal/psi, depending on the amount of cement solids contained in the slurry. As the slurry becomes dehydrated (i.e., as it sets), the compressibility is reduced. The compressibility of a particular liquid or liquid containing slurry can be experimentally determined for a rigid container by measuring the change in slurry volume caused by an applied pressure. Many containers, including the annulus of gas and oil wells, are somewhat elastic and not rigid. In elastic containers, the container volume increases due to the applied pressure, making it more difficult to assess the change in slurry volume.

One way of applying pressure to a liquid or liquid-containing slurry involves the use of a compression fluid applied above the first liquid or slurry, in a closed volume. The applied fluid may be water or air, for instance, or another liquid or gas. In the annulus of a gas or oil well, a drilling fluid, which can be oil or water-based, may already fill most of the annular space above the cement slurry. In this case, the applied fluid may be a third fluid (e.g. water or air) applied above a second fluid (drilling fluid) which, in turn, is above a first fluid (cement slurry).

When this method is employed, the combined compressibility of the first fluid and second (e.g., drilling) fluid may be monitored by measuring the changes in volume and pressure of the third (applied) fluid. The increase in volume occupied by the applied fluid minus any increase in volume of the container will offset the decrease in volume occupied by the first and second fluids, caused by the applied pressure. The following equation summarizes this relationship:

$$\Delta V_3 - \Delta V_C = -(\Delta V_1 + \Delta V_2)$$

Where $\Delta V_3$ = change in volume occupied by applied fluid $\Delta V_C$ = change in total container volume $\Delta V_1$ = change in volume occupied by cement slurry $\Delta V_2$ = change in volume occupied by drilling fluid As further explained above, the ratio $-\Delta V_1/\Delta AP$ is a constant ($K_1$) for a cement containing slurry, and is known as compressibility. By combining equations, the following can be derived:

$$K_1 = \frac{-\Delta V_1}{\Delta P} = \frac{(\Delta V_2 + \Delta V_3 - \Delta V_C)}{\Delta P}$$

$$\frac{\Delta V_3}{\Delta P} = K_1 + \frac{\Delta V_C - \Delta V_2}{\Delta P}$$

As the cement hardens over time, the compressibility $K_1$ of the cement slurry becomes less and less, and eventually approaches zero as the cement is completely set. Thus, the ratio $\Delta V_3/\Delta P$, which is the volume of applied fluid divided by the change in pressure, becomes less and less as the cement sets, and eventually levels off as shown by the following equations for completely set cement ($K_1$=O).

$$\frac{\Delta V_3}{\Delta P} = \frac{\Delta V_C}{\Delta P} - \frac{\Delta V_2}{\Delta P}$$

-continued $$= \frac{\Delta V_C}{\Delta P} - K_2$$

Where $K_2$ is the compressibility of the drilling fluid.

$$\frac{\Delta V_C}{\Delta P} = \frac{\text{change in container volume divided by}}{\text{applied pressure (limited for an underground well)}}$$

$\Delta V_C$ reflects the elasticity of the annular portion of the well bore. This value is actually reduced as the cement hardens because the portion of the well bore adjacent to the cement becomes sealed by the cement. After the cement hardens, only the elasticity of that portion of the well bore adjacent to the drilling fluid (if any) is relevant, and that value is constant. Because the compressibility $K_2$ of the drilling fluid is also constant, the overall value for $\Delta V_3/\Delta P$ is merely the sum of two constants ($\Delta V_C/\Delta P$ and $K_2$) after the cement hardens.

Referring to FIG. 1, a generally cylindrical well bore 10 is shown which extends below the surface of the ground 12. The well bore 10 includes an upper portion equipped with an outer bore casing or housing 14, which extends from above the ground to a lower end 16 which is below the ground, but is well above the bottom end 18 of the well bore. The well bore 10 also includes a lower portion which is not surrounded by an outer housing, but which is bounded on its side 20 by the earth.

A casing 22 is lowered into the well bore 10. Before proceeding with the drilling or completing operations, the casing 22 must be sealed into place. This is accomplished by pumping a cement slurry 26 into the annulus 28 surrounding the casing. This may be assisted by a cement wiper plug 24. The annulus 28 is defined as the space between the casing 22 and the outer housing 14 in the upper portion of the well bore 10, and between the casing 22 and the outer earth boundary 20 in the lower portion of the well bore 10. The cement slurry 26 should fill at least a substantial portion of the annulus 28. Once the cement slurry has been installed, it will occupy a volume $V_1$ which extends from the bottom 18 of the bore 10 up to the top of cement (TOC) 30 in the annulus 28. Drilling fluid 33 typically occupies a volume $V_2$ above the cement slurry and terminates at a fluid line 31. Sometimes, the cement slurry 6 is installed all the way to the earth's surface, and the drilling fluid 33 is removed.

The cement slurry 26 will harden and set over time, typically from the bottom up due to the fact that the deepest portions of well bore 10 have the highest temperatures. It is desired to monitor the compressibility of fluids in the annulus (including cement slurry 26) until the cement slurry has completely hardened, at which time its individual compressibility approaches zero and becomes immeasurably low. To accomplish this, a plug or seal 32 is installed at or near the top of the housing 14. The seal 32, the fluid line 31, and the outer and inner walls of the annulus 28 define a closed volume $V_3$ in the annulus 28 above fluid line 31. The volumes $V_1$, $V_2$, and $V_3$ add up to a total annular volume $V_C$.

An applied fluid, which can be liquid water, air, or another liquid or gas, is injected into the annulus 28 until the volume $V_3$ is filled. The applied fluid may be injected via inlet channel 34 connected to a fluid generator 36. The volume or change in volume ($\Delta V_3$) of the applied fluid can be monitored using a flow meter 38 in communication with the inlet channel 34. The pressure of the applied fluid, or change in pressure, can be monitored using pressure transducer 40 in communication with annulus 28. The pressure transducer 40 may be located near the top of annulus 28 as shown.

To monitor the compressibility of cement slurry 26, additional applied fluid is injected into the already full annulus 28, causing the volume $V_3$ above the fluid line 31 to increase, and compressing the drilling fluid 33 and cement slurry 26 to lesser volumes. The increase in the applied fluid volume ($\Delta V_3$) minus any increase in the total annular volume ($\Delta V_C$) is equal to the decrease in volumes ($\Delta V_1$ and $\Delta V_2$) occupied by the cement slurry 26 and drilling fluid 33 (if present). As the volume $\Delta V_3$ is increased, the pressure $\Delta P$ measured by transducer 40 also increases. The applied fluid is injected until the pressure $\Delta P$ reaches a target value of, for example, 100 psi. The ratio $\Delta V_3/\Delta P$ is then determined, and the applied pressure is relaxed.

From the above equations, it can be seen that the compressibility of cement slurry 26 is proportional to the changes in volumes ($\Delta V_2$, $\Delta V_3$ and $\Delta V_C$) divided by the change in pressure ($\Delta P$). Before the cement 26 begins to set, it will exist entirely as a slurry, and a relatively large change in volume ($\Delta V_3$) of the applied fluid will be required to increase the pressure by the target amount above an initial (e.g. relaxed) pressure. The term "relaxed pressure" is defined as the amount fluid pressure existing at the transducer 40 when the volume $V_3$ is just filled with the applied fluid, but is not overfilled to create additional pressure. As the cement 26 sets, less and less increase in the volume $V_3$ will generate the same target increase in pressure, over the relaxed value. When the cement 26 is completely set, a relatively constant residual increase in volume $V_3$ will be required to effect the target pressure increase. If the cement slurry is installed all the way to the surface, so that no drilling fluid remains in annulus 28, the increase in volume ($\Delta V_3$) will approach zero as the cement becomes completely set.

The above process may be repeated at appropriate increments of time, until the cement 26 is fully hardened and, compressibility levels off at the target pressure change. The target pressure change used for the testing may vary depending on the fracture gradient of the walls in the annulus 28, and the density of fluids therein. Each time the target pressure change is reached, the change in volume $\Delta V_3$ is recorded, and the ratio $\Delta V_3/\Delta P$ is calculated to determine a number which is proportional to the compressibility of cement slurry 26.

It is well known that cement slurries, when left stagnant, will tend to form gels before solidifying. The gel formation is undesirable because it causes localized shrinkage of the cement, and inconsistencies such as gas pockets in the cement. In order to alleviate gel formation, various techniques are known for keeping the cement particles in motion until the slurry has solidified. It is preferred that one or more of these techniques be employed in conjunction with the method of the invention so that the cement sets in a homogeneous and consistent fashion.

In one such technique, the cement is homogenized and kept in motion by applying random or periodic, pulsating, oscillating or vibrating pressure to the cement slurry until it has completely set. This technique is described in U.S. Pat. No. 5,377,753, issued to Haberman et al., the disclosure of which is incorporated by reference. The fluid from the fluid generator 36, described herein, is applied in pulses. For instance, the fluid generator 36 may be a water pulse generator (WPG) or an air pulse generator (APG).

The pulsating fluid pressure from the fluid generator 36 can have a very rapid (e.g., square wave) shape, a more gradual (e.g. sinusoidal wave) shape, or any other type of wave shape. The pulsating or vibrating component of the pressure may be a resonant type of vibration. The pressure pulses are transmitted through the cement slurry 26, setting the individual cement particles in motion and overcoming the inter-particle attractions that cause gelling.

One cause of gas pockets entering cement is the loss of hydrostatic pressure caused by gelling. Applying periodic or random pressure pulses to the cement slurry from above, during transition from a liquid slurry to a solid, delays the loss in hydrostatic pressure until the viscosity of the cement prevents gas and other fluids from invading it.

To pulsate or oscillate the applied fluid from fluid generator 36, an oscillating device can be installed in the inlet channel 34 between the fluid generator 36 and the annulus 28. It may apply pressure pulses consisting of air or water, or another gas or liquid. The frequency, amplitude, wave shape and time of pressure application may or may not be important, and may be tailored to provide optimum cement bonding and setting.

When water or air is used as the applied fluid, and the cycle time is low enough that the compressibility of the fluids in annulus 28 is in equilibrium with the applied pressure, the $\Delta V_3/\Delta P$ of the individual cycles can be used to monitor the compressibility at the same time that this process is applied. If this cannot be accomplished, it may be desirable to stop the vibration or oscillation of fluid pressure before measuring the compressibility.

Figure 2:
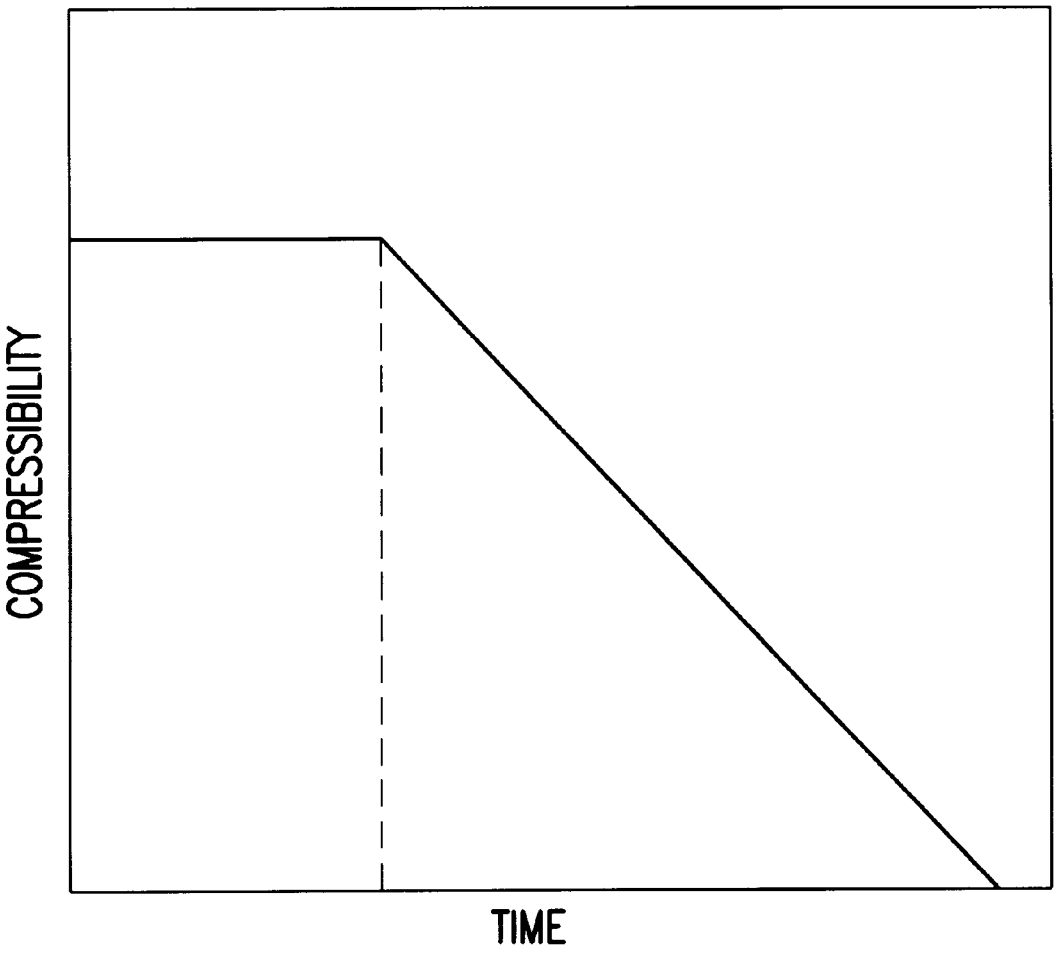
FIG. 2 is a graph showing the compressibility versus time of cement injected into the annulus of a typical well bore.

FIG. 2 illustrates the general behavior of the cement compressibility over time after cement 26 has been pumped into the annulus 28 of the well bore 10. After pumping, the cement does not begin to set for a period of time to the left of the dotted line. For instance, this period of no setting may last from less than an hour to several hours. During that time, the compressibility of the cement slurry remains fairly constant.

Once the cement slurry begin to set, its compressibility declines over the time period represented to the right of the dotted line. The decline continues until the setting is complete, at which time its individual compressibility approaches zero.

The foregoing method provides a useful way of monitoring the setting of cement, especially in the annulus of an oil well bore, by monitoring its change in compressibility during setting. The method allows the user to determine the earliest time at which the setting is complete, so that drilling and other oil well operations may resume without undue delay.

EXAMPLES

Tests were performed on shallow vertical wells, without gas migration problems. The wells were drilled in the North Concho (Queen) Field near Odessa, Texas. For each well, an 8⅝ inch (outer) surface casing was set to a 1500 foot depth. A bore was drilled through the outer casing to a total depth of about 4700 feet using a 7⅞ inch drill bit and low solids (10 lb/gal) brine. The open hole washed out to about a 9-inch diameter.

A 5½ inch production casing was installed in the bore, and cement was installed in the annulus all the way to the surface using a lead slurry consisting of 12.8 lb/gal 35/65 POZ/Class H cement with 6% bentonite, and a tail slurry consisting of 14.2 lb/gal 50/50 POZ/Class H cement with 2% bentonite. The top of the tail slurry was about 3,000 feet deep. As the cement slurry extended to the surface, no significant amount of drilling fluid remained in the annulus.

The theoretical values for the compressibility, V/P, for the annular volume of the Queen wells were calculated to be 0.018 gal/psi for pure water and 0.012 gal/psi for the cement slurries used, assuming a completely rigid well bore. The apparent values reported below were substantially higher (e.g., by factors of 3 to 5) due to the elasticity of the annulus in the well bores.

Eight Queen wells were tested for compressibility using different fluids and conditions. The test conditions are listed in Table 1 below.

In Table 1, "WPG" denotes a water pulse generator and "APG" denotes an air pulse generator with either a 185 cfm or a 375 cfm compressor. The term "delay" refers to the length of time after the cement was pumped before the applied pressure vibration was started. The delay time is not included in FIG. 3.

Figure 3:
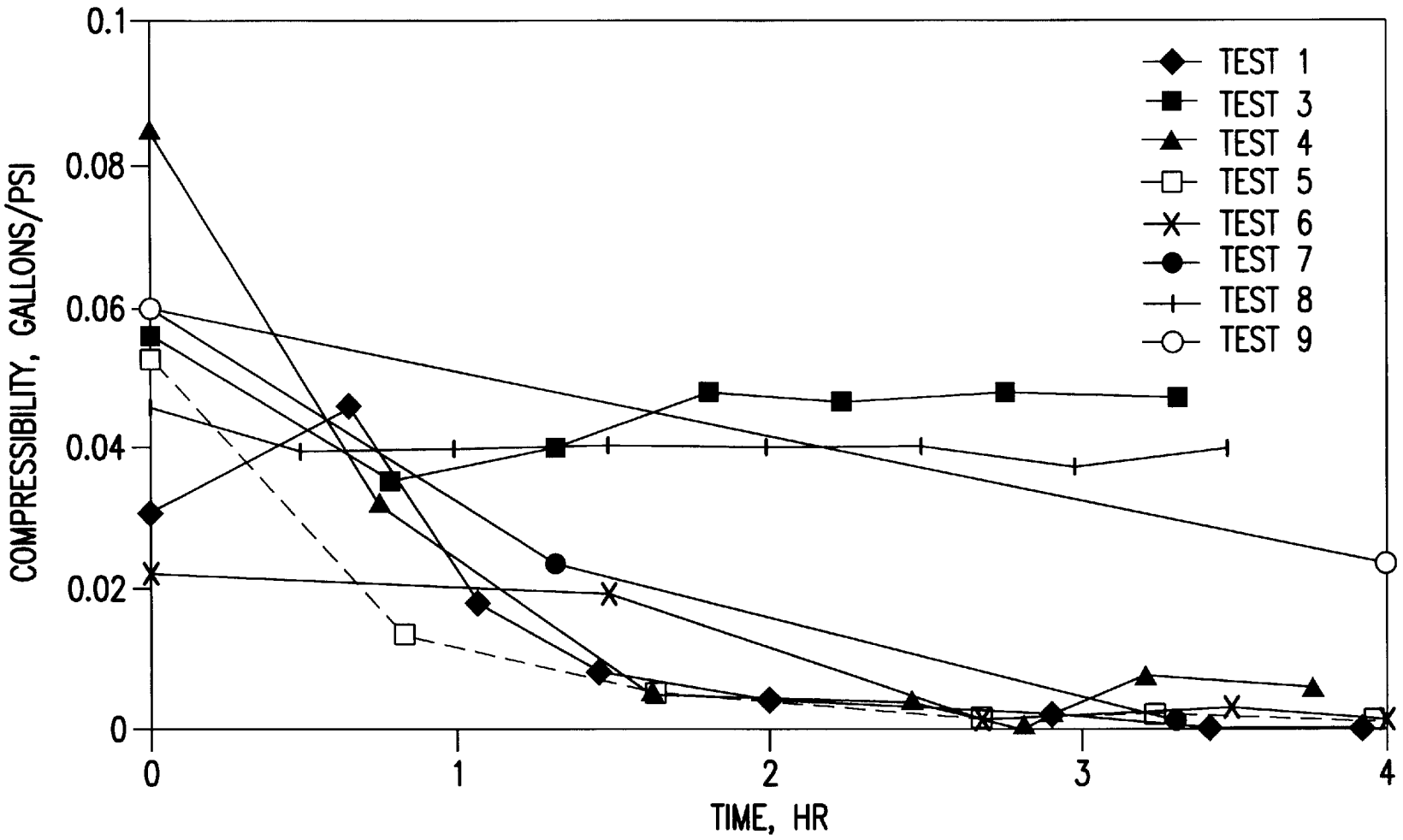
FIG. 3 is a graph showing the actual compressibility versus time in the annulus of several well bores, using different applied compression fluids and conditions as explained in the Examples.

The term "slope" refers to the maximum rate of decline of compressibility of each curve in FIG. 3. The term "inter" refers to the intercept of the interval with the maximum rate of decline, with the horizontal axis in FIG. 3.

TABLE 1

Summary of Compressibility Data

| | | Compressibility | | |
|---|---|---|---|---|
| Test No. | Conditions | Delay (min) | Slope (gal/psi-hr) | Inter (hr) |
| 1 | WPG | 25 | 0.069 | 1.8 |
| 2 | Control | (no compressibility measurements) | | |
| 3 | WPG | 20 | None | None |
| 4 | APG (185 cfm) | 70 | 0.072 | 2.4 |
| 5 | APG (375 cfm) | 20 | 0.049 | 1.4 |
| 6 | APG (375 cfm) | 30 | 0.015 | 3.2 |
| 7 | Air Control (no pulse) | 10 | 0.019 | 3.2 |
| 8 | APG (185 cfm) | 30 | None | None |
| 9 | APG (185 cfm) | 65 | 0.010 | 7.2 |

When water was used to measure compressibility, vibration was stopped and the annulus was pumped full of water. The volume of water required to increase pressure was measured in three pressure ranges, 0–40 psi, 40–80 psi, and 80–120 psi. The measured compressibility was independent of the pressure range.

When compressibility was measured using air, the vibration was not stopped. A pressure activated ΔPG injected air into the annulus until the pressure reached 100 psi, then exhausted it until the pressure reached 3 psi. The time required to increase the pressure to 100 psi was measured with a stop watch, and compared to a calibration curve to determine the corresponding volume of air. The calibration curve for air was determined, for each APG, by injecting air into tanks with known headspace volumes and plotting the times required to reach 100 psi at each volume.

The WPG used was made from a modified 2-inch air powered dual diaphragm pump. It had a displacement of about 0.5 gal, resulting in vertical motion of about 4 in. in the annulus of the Queen wells. The half peak width was 0.2–0.5 sec and it cycled about every 1–3 sec. The pressure rating was 120 psi.

After the tests, an improved WPG was machined from aluminum alloy halves bolted together to provide an internal chamber. Compressed air or nitrogen was introduced into one end of the chamber to accelerate a pulse of water out the other end. The water was separated from the gas by a diaphragm made for the pump mentioned above. Electronically controlled valves were used to inject and exhaust the gas, and the back pressure of the water returned the diaphragm to its initial positive. It provided a water pulse with a displacement of about 0.5 gal. and a half peak width of about 0.2 sec. The pressure rating was 400 psi.

The APG's used injected and exhausted compressed air directly to and from the annulus. They were basically the improved WPG described above, without the chamber and diaphragm. They had no displacement limitation, and provided an average vertical motion of 3.5 feet at 100 psi in the Queen wells. They consisted of fast acting (0.05 sec), large volume (up to 1.5 in pipe size), pilot operated air vales, with electronic or pneumatic control. They were either time activated or pressure activated. Time activated air pulse generators were used at the rate of one cycle every 10 sec (0.1 Hz), for these tests, 5 sec for pressurization and 5 sec for exhaust. Compressed air in the pressure range of 100–120 psi was provided through a 50 ft. length of ¾ in or 2 in hose, respectively, from trailer-mounted rental air compressors with deliveries of 185 or 375 cfm at atmospheric pressure.

The compressibilities were measured over a four-hour time period, and the results plotted (FIG. 3). As shown in FIG. 3, different wells had significantly different setting times for the cement in the annulus. For the wells of Test Nos. 1, 4, 5, 6 and 7, the cement was completely set within the first 3–4 hours, as evidenced by the rapid declines in compressibility to near zero within that period. For the wells of Test Nos. 3 and 8, the cement had no significant setting within 3–4 hours, as evidenced by little or no decline in compressibility. For these wells, longer setting times were needed. For the well of Test No. 9, the compressibility of the cement declined in four hours, but did not level off or approach zero. This indicates that the cement only partially set.

The variability in cement setting times for similar wells underscores the importance of the invention in providing an accurate monitoring method. Without accurate monitoring, one cannot accurately predict the cement setting time for a particular well.

While the embodiments of the invention disclosed herein are presently preferred, various modifications and improvements can be made without departing from the spirit and scope of the invention. The scope of the invention indicated by the appended claims, and all changes that fall within the meaning and range of equivalents are intended to be embraced therein.

I claim:

1. A method of monitoring the setting of a settable solid/liquid slurry material, comprising the steps of:

a) applying a pressure to the settable slurry material;

b) measuring a change in volume associated with the applied pressure;

c) determining a compressibility based on the change in volume caused by the applied pressure; and d) determining when the material is completely set.

2. The method of claim 1, wherein at least steps a) and b) are repeated periodically until the change in volume levels off.

3. The method of claim 1, wherein the settable slurry material comprises cement.

4. The method of claim 1, wherein the pressure is applied using an applied fluid.

5. The method of claim 4, wherein the applied fluid comprises water.

6. The method of claim 4, wherein the applied fluid comprises air.

7. The method of claim 4, wherein the applied fluid is applied above the settable slurry material.

8. The method of claim 1, wherein another fluid is present between the applied fluid and the settable slurry material.

9. The method of claim 1, wherein the pressure is applied in pulses.

10. A method of monitoring the setting of a settable material, comprising the steps of:

a) providing a closed volume including the settable slurry material;

b) adding an applied fluid into the closed volume;

c) increasing the amount of applied fluid in the closed volume until there is a pressure increase in the closed volume;

d) measuring a change in volume occupied by the applied fluid after the pressure increase; and e) determining when the material is completely set.

11. The method of claim 10, further comprising the step of dividing the change in volume occupied by the applied fluid by the amount of the pressure increase to monitor a compressibility.

12. The method of claim 10, wherein the amount of applied fluid in the closed volume is increased until a target pressure increase is achieved.

13. The method of claim 10, wherein the applied fluid comprises water.

14. The method of claim 10, wherein the applied fluid comprises air.

15. The method of claim 10, wherein the settable material comprises cement.

16. The method of claim 10, wherein steps c) and d) are repeated periodically until the change in volume levels off.

17. The method of claim 10, wherein step c) comprises a plurality of applied fluid pulses.

18. The method of claim 10, wherein the closed volume comprises an annular space in a well bore.

19. A method of monitoring the setting of a settable material in an annular space of a well bore, comprising the steps of:

a) measuring the compressibility of one or more fluids in the annular space;

b) repeating step a) periodically until the compressibility levels off; and c) determining when the material is completely set.

20. The method of claim 19, further comprising the steps of:

injecting an applied fluid into the annular space above the settable material until the annular space is full;

injecting an additional volume of the fluid into the annular space until there is a pressure increase in the annular space; and dividing the additional volume of the fluid by the amount of the pressure increase to monitor the compressibility of the settable material.

21. The method of claim 20, wherein the additional volume of fluid is injected into the annular space in pulses.

22. The method of claim 19, wherein the settable material comprises a solid/liquid slurry.

23. The method of claim 19, wherein the settable material comprises cement.

* * * * *